US009592173B2

(12) United States Patent
Wang

(10) Patent No.: US 9,592,173 B2
(45) Date of Patent: Mar. 14, 2017

(54) FORCE FEEDBACK TYPE COMPLIANT ORTHOTIC DEVICE

(71) Applicant: Hiwin Technologies Corp., Taichung (TW)

(72) Inventor: Ren-Jeng Wang, Taichung (TW)

(73) Assignee: HIWIN TECHNOLOGIES CORP., Taichung (TW)

( * ) Notice: Subject to any disclaimer, the term of this patent is extended or adjusted under 35 U.S.C. 154(b) by 388 days.

(21) Appl. No.: 14/257,626

(22) Filed: Apr. 21, 2014

(65) Prior Publication Data

US 2015/0173992 A1 Jun. 25, 2015

(30) Foreign Application Priority Data

Dec. 19, 2013 (TW) ..... 102147224 A

(51) Int. Cl.
*A61H 1/02* (2006.01)

(52) U.S. Cl.
CPC ..... *A61H 1/02* (2013.01); *A61H 1/0277* (2013.01); *A61H 2201/1215* (2013.01); *A61H 2201/1481* (2013.01); *A61H 2201/165* (2013.01); *A61H 2201/5069* (2013.01); *A61H 2201/5092* (2013.01); *A61H 2230/605* (2013.01)

(58) Field of Classification Search
CPC ..... A61H 1/02; A61H 1/0277; A61H 2201/1215; A61H 2201/1481; A61H 2201/5069; A61H 2201/165; A61H 2201/5092; A61H 2230/605; A61H 1/00; A61H 1/0237; A61H 1/0274; A61H 2201/00; A61H 2201/0157; A61H 2201/12; A61H 2201/1207; A61H 2201/123; A61H 2201/1463; A61H 2201/149; A61H 2201/1635; A61H 2201/1638; A61H 2201/1664; A61H 2201/1666; A61H 2201/1671; A61H 2201/1676; A61H 2201/50; A61H 2201/5007; A61H 2201/5078; A61H 2205/00; A61H 2205/06;
(Continued)

(56) References Cited

U.S. PATENT DOCUMENTS 8,211,042 B2 7/2012 Gilbert et al.
2008/0009771 A1* 1/2008 Perry ..... B25J 9/0006 600/587

(Continued)

*Primary Examiner* — Quang D Thanh
(74) *Attorney, Agent, or Firm* — Muncy, Geissler, Olds & Lowe, P.C.

(57) ABSTRACT

A Force feedback type compliant orthotic device includes a fixing base, driving unit, first limb supporting unit, and second limb supporting unit. The driving unit has a motor disposed at the fixing base and an output shaft connected to the motor. The output shaft is inserted into a joint base to connect with a resilience unit. The first limb supporting unit has a first supporting element fixed at the fixing base and a first electromyographic signal sensor disposed at the first supporting element. The second limb supporting unit has a second supporting element disposed at the joint base and a second electromyographic signal sensor disposed at the second supporting element. The motor generates appropriate auxiliary power according to the sensing result of the first and second electromyographic signal sensors, such that the first and second supporting elements move relative to each other precisely.

10 Claims, 8 Drawing Sheets

(58) Field of Classification Search
CPC ..... A61H 2205/065; A61H 2205/10; A61H 2205/102; A61H 2205/106; A61H 2205/108
See application file for complete search history.

(56) References Cited

U.S. PATENT DOCUMENTS

| | | | | |
|---|---|---|---|---|
| 2008/0071386 | A1 | 3/2008 | McBean et al. | |
| 2008/0108918 | A1* | 5/2008 | Joutras ..... | A61H 1/02 601/34 |

* cited by examiner

FORCE FEEDBACK TYPE COMPLIANT ORTHOTIC DEVICE

BACKGROUND OF THE INVENTION

1. Technical Field

The present invention relates to rehabilitation aids, and more particularly, to a Force feedback type compliant orthotic device.

2. Description of Related Art

Patients with stroke, brain injury, or any other neurological injury usually need to undergo rehabilitation for a long period of time in order to restore the functions of their muscles and joints and preclude ensuing muscular dystrophy and joint degeneration.

To free patients from dependence on a third party in receiving rehabilitation, conventional rehabilitation aids are developed and commercially available. For example, U.S. Pat. No. 8,211,042 discloses a magnetorheological damper and a friction brake for use in rehabilitation or for functioning as a prosthetic joint. However, U.S. Pat. No. 8,211,042 lacks any driving source and thus gives limited benefits to a user. Moreover, US2008/0071386 discloses an electromyographic signal sensor for use in making judgment and thus serving as a driving device for generating a driving force, but it has a drawback, that is, the magnitude of the driving force must be controlled by mathematical computation performed with a virtual spring constant and a virtual damping coefficient, thereby not only causing signal transmission delay, but also compromising precision in signal processing due to external interference.

SUMMARY OF THE INVENTION

It is an objective of the present invention to provide a Force feedback type compliant orthotic device characterized by ease of operation, quick response, and high stability.

In order to achieve the above and other objectives, the present invention provides a Force feedback type compliant orthotic device comprising a fixing base, a driving unit, a joint base, a resilience unit, a first limb supporting unit, and a second limb supporting unit. The driving unit has a motor disposed at the fixing base, a decelerator disposed at the fixing base and connected to the motor, and an output shaft connected to the decelerator. The joint base has a ring portion and a supporting arm. The ring portion is disposed rotatably at the decelerator of the driving unit and adapted to hold snugly the output shaft of the driving unit. The supporting arm extends radially and outward from the outer rim surface of the ring portion. The resilience unit has a mounting base and a plurality of resilient elements disposed at the mounting base. The mounting base holds the output shaft of the driving unit snugly and connects with an inner rim surface of the ring portion of the joint base, such that the resilience unit is driven by the output shaft to drive the joint base to rotate synchronously. The first limb supporting unit has a first supporting element disposed at the fixing base and a first electromyographic signal sensor disposed at the first supporting element. The second limb supporting unit has a second supporting element and a second electromyographic signal sensor. The second supporting element is disposed at the supporting arm of the joint base. The second electromyographic signal sensor is disposed at the second supporting element.

As indicated above, muscular functions are assessed according to the electromyographic signals sensed by the first and second electromyographic signal sensors, such that the motor can generate and transmit sufficient auxiliary power to the resilience unit. Then, the mounting base of the resilience unit drives the joint base to operate synchronously, and the resilient elements of the resilience unit undergo deformation to serve a force controlling purpose. In doing so, the second carrying element can move relative to the first carrying element in a precise and stable manner, thereby enhancing the efficacy of rehabilitation for a user.

Preferably, a rotational damper is disposed on the end surface of the ring portion of the joint base. The rotational damper is connected to the fixing base through a connecting shaft to impose a damping effect on the joint base and thus enhance operation stability.

Preferably, a rotational encoder is disposed at the motor of the driving unit to measure the angle by which a drive shaft of the motor rotates. A rotational potentiometer is disposed in the output shaft of the driving unit. An end of the rotational potentiometer is fixedly disposed in a rotating shaft of the decelerator. Another end of the rotational potentiometer is fixedly disposed in the connecting shaft to measure angular variation between the rotating shaft and the connecting shaft.

Preferably, the first supporting element has a first brace and a first clamp band. The first brace is disposed at the fixing base and undergoes three-axis position adjustment relative to the fixing base as needed. The outer rim surface of the first clamp band is disposed at the first brace. The first electromyographic signal sensor is disposed on the inner rim surface of the first clamp band.

Preferably, the second supporting element has a second brace and a second clamp band. The second brace is disposed at the supporting arm of the joint base and undergoes three-axis position adjustment relative to the fixing base as needed. The outer rim surface of the second clamp band is disposed at the second brace. The second electromyographic signal sensor is disposed on the inner rim surface of the second clamp band.

DETAILED DESCRIPTION OF THE EMBODIMENT OF THE INVENTION

Figure 1:
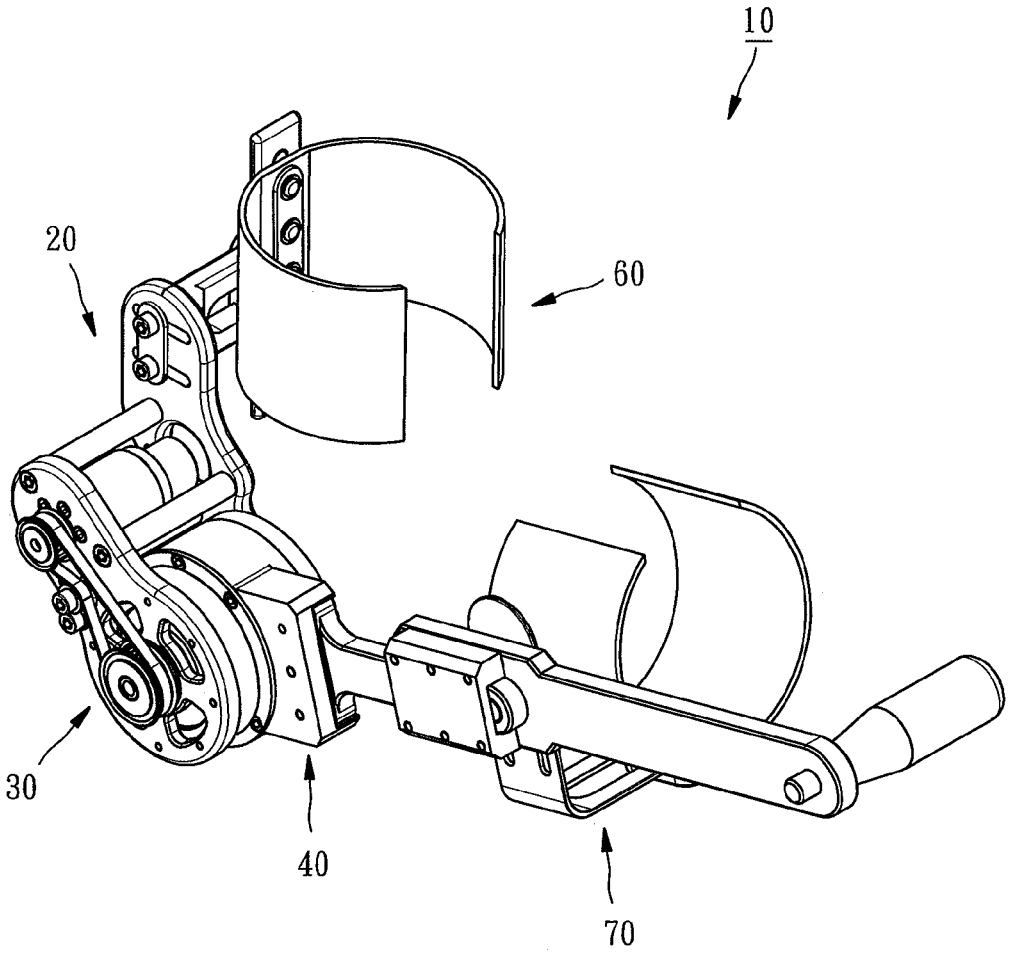
FIG. 1 is a perspective view of a Force feedback type compliant orthotic device of the present invention.
Figure 2:
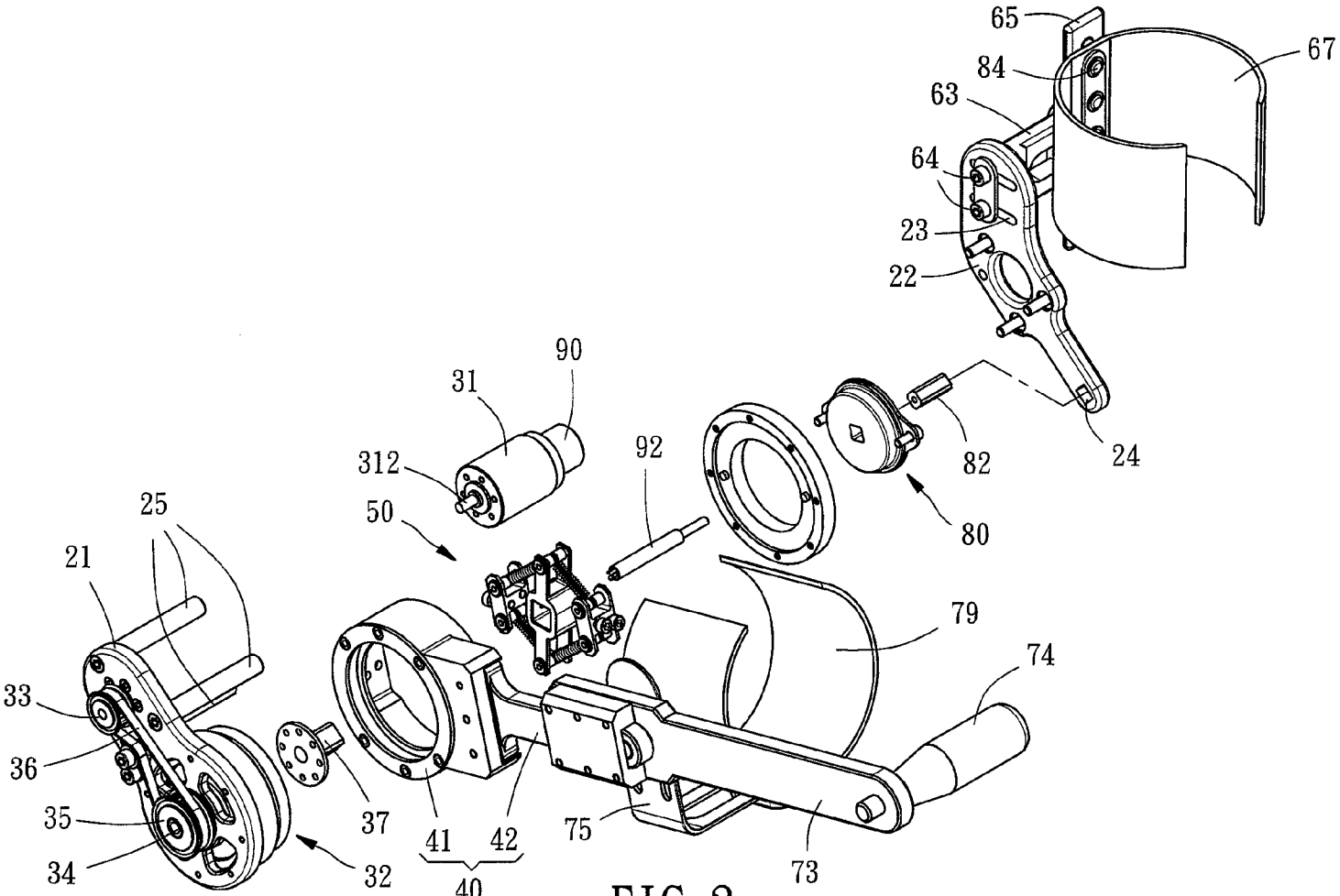
FIG. 2 is a partial exploded view of the Force feedback type compliant orthotic device of the present invention.

Referring to FIG. 1 and FIG. 2, a Force feedback type compliant orthotic device 10 of the present invention comprises a fixing base 20, a driving unit 30, a joint base 40, a resilience unit 50, a first limb supporting unit 60, and a second limb supporting unit 70.

The fixing base 20 has a first fixing board 21 and a second fixing board 22. The top end of the second fixing board 22 has two parallel X-axis adjustment slots 23. The bottom end of the second fixing board 22 has a rectangular hole 24. Upon completion of an assembly process, the first and second fixing boards 21, 22 are connected by three rods 25.

The driving unit 30 has a motor 31 and a decelerator 32. The motor 31 is fixed to the inner surface of the first fixing board 21 of the fixing base 20 and has a drive shaft 312. The drive shaft 312 passes through the first fixing board 21 to connect with a first transmission wheel 33. The decelerator 32 is disposed on the inner surface of the first fixing board 21 of the fixing base 20 through a rotating shaft 34. An end of the rotating shaft 34 passes through the first fixing board 21 to connect with a second transmission wheel 35. A transmission belt 36 is windingly disposed between the first and second transmission wheels 33, 35. Moreover, the driving unit 30 further has an output shaft 37. An end of the output shaft 37 connects with the decelerator 32 and thus operates together with the decelerator 32 synchronously. Therefore, when the motor 31 starts to operate, the drive shaft 312 of the motor 31 drives the first transmission wheel 33 to rotate, then the transmission belt 36 enables the first transmission wheel 33 to drive the second transmission wheel 35 to rotate, and eventually the second transmission wheel 35 drives the decelerator 32 through the rotating shaft 34, such that the output shaft 37 operates together with the decelerator 32.

The joint base 40 has a ring portion 41 and a supporting arm 42. The ring portion 41 rotatably connects with an end of the decelerator 32 and snugly holds the output shaft 37. The supporting arm 42 extends radially and outward from the outer rim surface of the ring portion 41.

Figure 3:
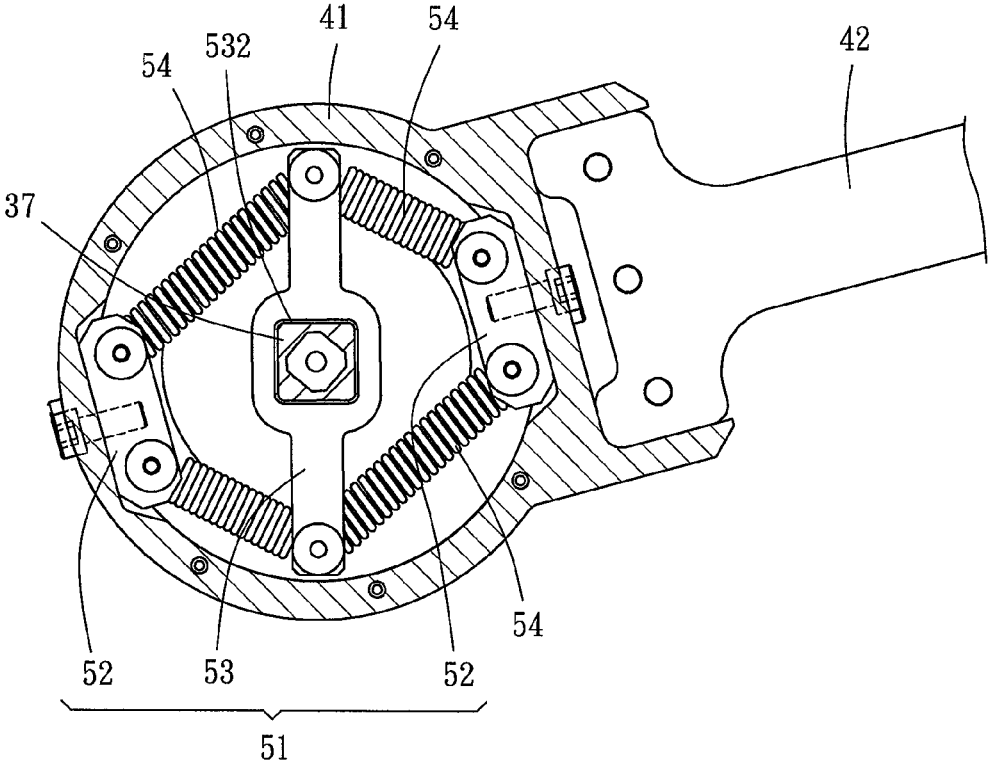
FIG. 3 is a plan view of a joint base and a resilience unit which are put together according to the present invention.

Referring to FIG. 2 and FIG. 3, the resilience unit 50 has a mounting base 51. The mounting base 51 has two first frames 52 and a second frame 53. The first frames 52 are each fixed to an inner rim surface of the ring portion 41 of the joint base 40. The second frame 53 is disposed between the two first frames 52 and has an axial hole 532 for holding the output shaft 37 snugly. Moreover, the second frame 53 is of a height larger than that of each of the first frames 52. A resilient element 54 is connected between the top end of the second frame 53 and the top end of each of the first frames 52. Another resilient element 54 is connected between the bottom end of the second frame 53 and the bottom end of each of the first frames 52. Hence, the second frame 53 of the mounting base 51 is driven by the output shaft 37 to start to rotate. During its rotation, the second frame 53 of the mounting base 51 drives the first frames 52 of the mounting base 51 through the resilient elements 54, such that the joint base 40 rotates together with the mounting base 51.

Figure 7:
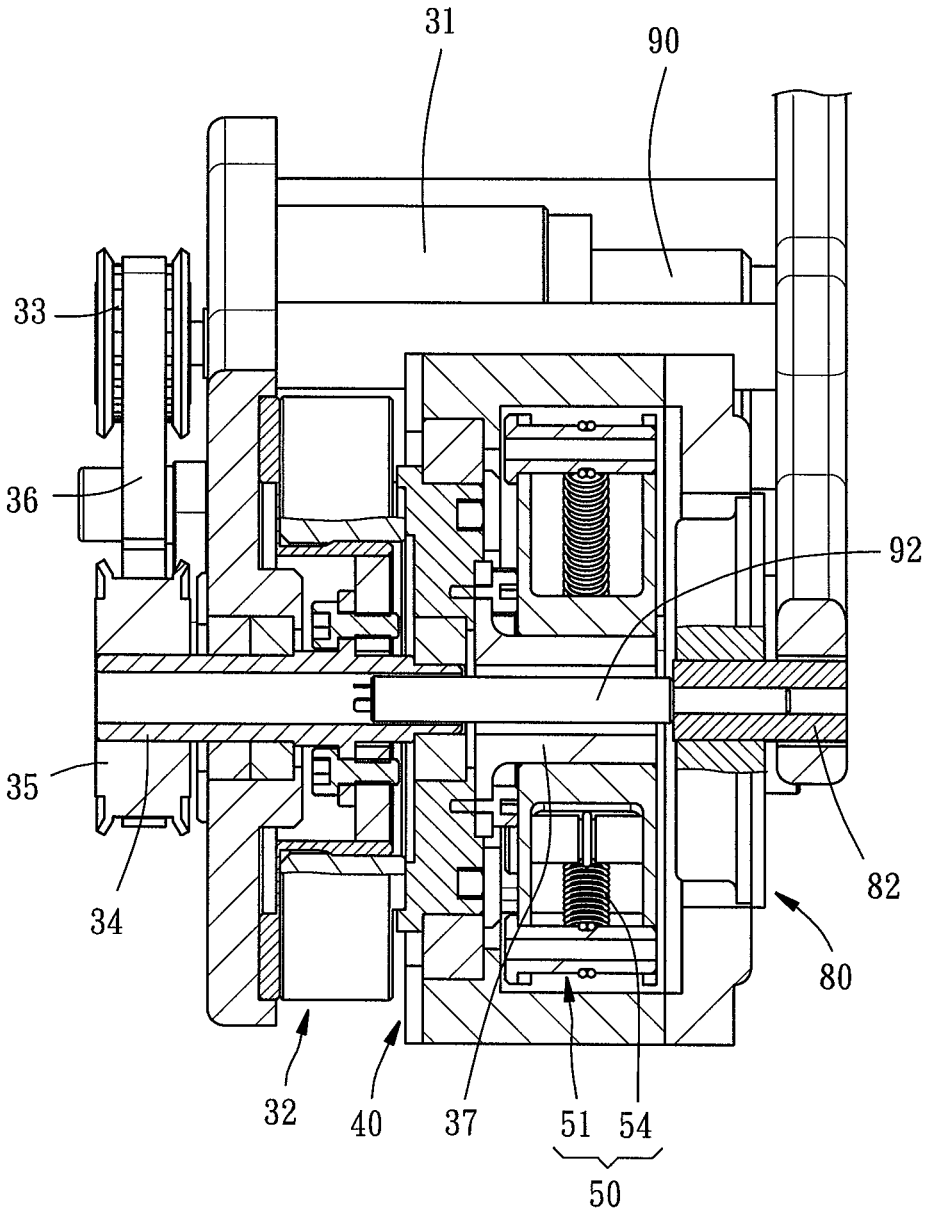
FIG. 7 is a partial cross-sectional view of the Force feedback type compliant orthotic device taken along line 7-7 of FIG. 6.

To maintain the stability of the joint base 40 during the rotation thereof, the present invention further provides a rotational damper 80. The rotational damper 80 is attributed to the prior art, and thus its fine structure and operation principle are not described herein for the sake of brevity. Referring to FIG. 2 and FIG. 7, not only is the rotational damper 80 fastened to the end surface of the ring portion 41 of the joint base 40, but a connecting shaft 82 is also inserted into the rectangular hole 24 of the second fixing board 22 of the fixing base 20, such that the rotational damper 80 can be mounted to thereby have a damping effect on the joint base 40, wherein the connecting shaft 82 and the rotating shaft 34 of the decelerator 32 are coaxial.

Figure 4:
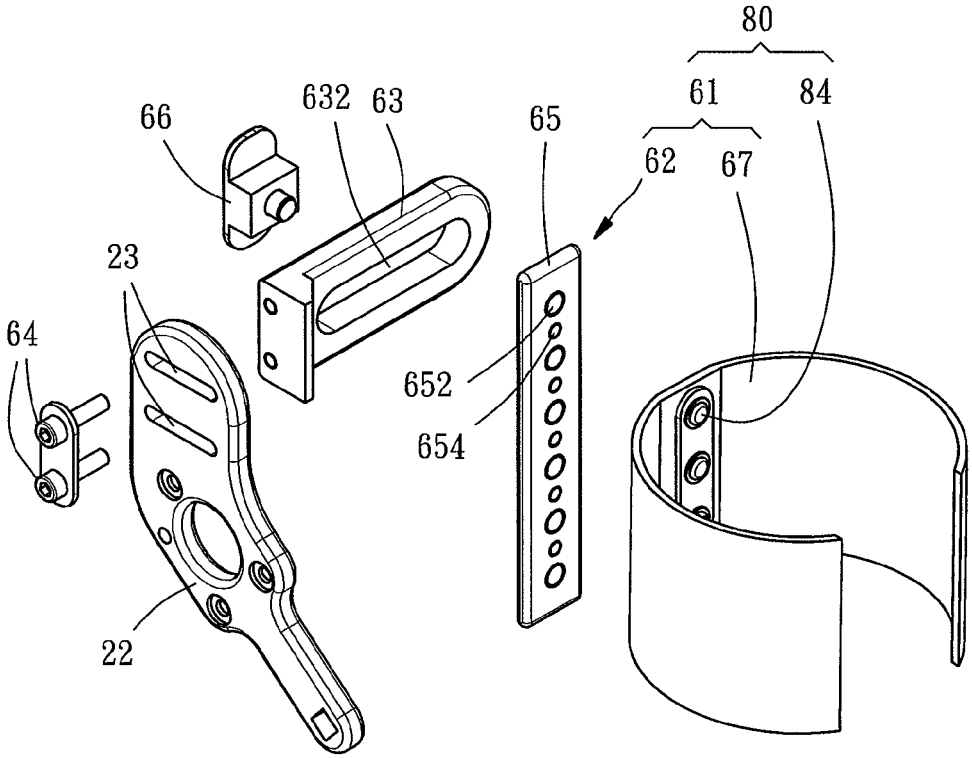
FIG. 4 is an exploded view of a first limb supporting unit according to the present invention.

Referring to FIG. 2 and FIG. 4, the first limb supporting unit 60 has a first supporting element 61. The first supporting element 61 has a first brace 62. The first brace 62 has a first transverse plate 63, two first transverse plate fixing elements 64, a first vertical plate 65, and a first vertical plate fixing element 66. The first transverse plate 63 has a first Y-axis adjustment slot 632. The first transverse plate fixing elements 64 are disposed slidably in the X-axis adjustment slot 23 of the second fixing board 22 of the fixing base 20 and fixed to an end of the first transverse plate 63, such that the first transverse plate 63 can perform forward and backward position adjustment. The first vertical plate 65 has a plurality of Z-axis positioning holes 652 and a plurality of first fixing holes 654 alternating with the plurality of Z-axis positioning holes 652. The first vertical plate fixing element 66 is disposed slidably in the first Y-axis adjustment slot 632 of the first transverse plate 63 and selectively fixedly disposed in one of the Z-axis positioning holes 652 of the first vertical plate 65, such that the first vertical plate 65 can perform lateral and vertical position adjustment. Moreover, the first supporting element 61 further has a first clamp band 67 for holding the arm. A plurality of first electromyographic signal sensors 84 is disposed on an inner rim surface of the first clamp band 67. An end of each of the first electromyographic signal sensors 84 passes through the first clamp band 67 and is fixedly disposed in a corresponding one of the first fixing holes 654 of the first vertical plate 65, such that the first clamp band 67 and the first vertical plate 65 are fixed to each other. Hence, the first clamp band 67 can undergo three-axis position adjustment to meet a user's need.

Figure 5:
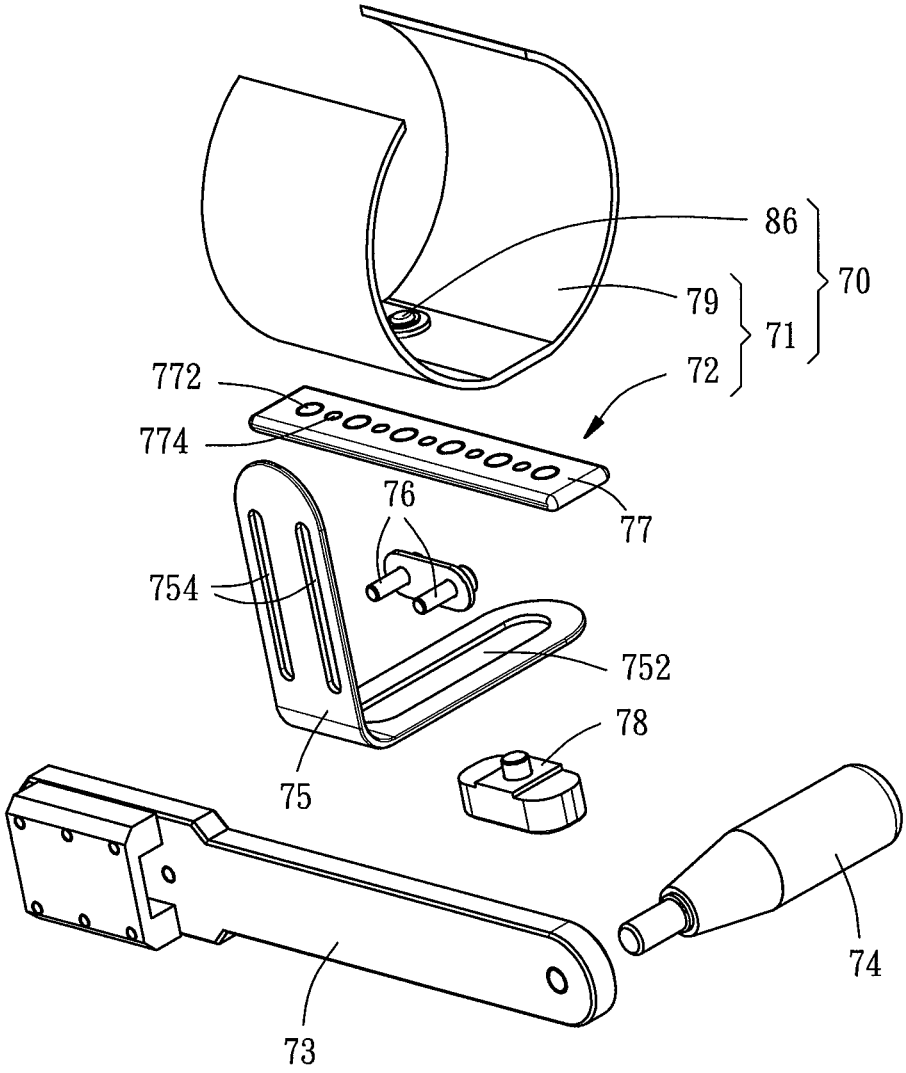
FIG. 5 is an exploded view of a second limb supporting unit according to the present invention.

Referring to FIG. 2 and FIG. 5, the second limb supporting unit 70 has a second supporting element 71. The second supporting element 71 has a second brace 72. The second brace 72 has an extension arm 73, a handle 74, an L-shaped vertical plate 75, two second vertical plate fixing elements 76, a second transverse plate 77, and a second transverse plate fixing element 78. The extension arm 73 has an end connected to the terminal end of the supporting arm 42 of the joint base 40 and another end connected to the handle 74. The L-shaped vertical plate 75 has a second Y-axis adjustment slot 752 and two Z-axis adjustment slots 754. The second vertical plate fixing elements 76 are disposed slidably in the two Z-axis adjustment slots 754 of the L-shaped vertical plate 75, respectively, and fixed to the extension arm 73, such that the L-shaped vertical plate 75 can perform vertical position adjustment. The second transverse plate 77 has a plurality of X-axis positioning holes 772 and a plurality of second fixing holes 774 alternating with the plurality of X-axis positioning holes 772. The second transverse plate fixing element 78 is disposed slidably in the second Y-axis adjustment slot 752 of the L-shaped vertical plate 75 and selectively fixedly disposed in one of the X-axis positioning holes 772 of the second transverse plate 77, such that the second transverse plate 77 can perform forward, backward, and lateral position adjustment. Moreover, the second supporting element 71 further has a second clamp band 79 for holding the forearm. A plurality of second electromyographic signal sensors 86 is disposed on an inner rim surface of the second clamp band 79. An end of each of the second electromyographic signal sensors 86 passes through the second clamp band 79 and is fixedly disposed in a corresponding one of the second fixing holes 774 of the second transverse plate 77, such that the second clamp band 79 and the second transverse plate 77 are fixed to each other. Hence, the second clamp band 79 can undergo three-axis position adjustment to meet the user's need.

Figure 6:
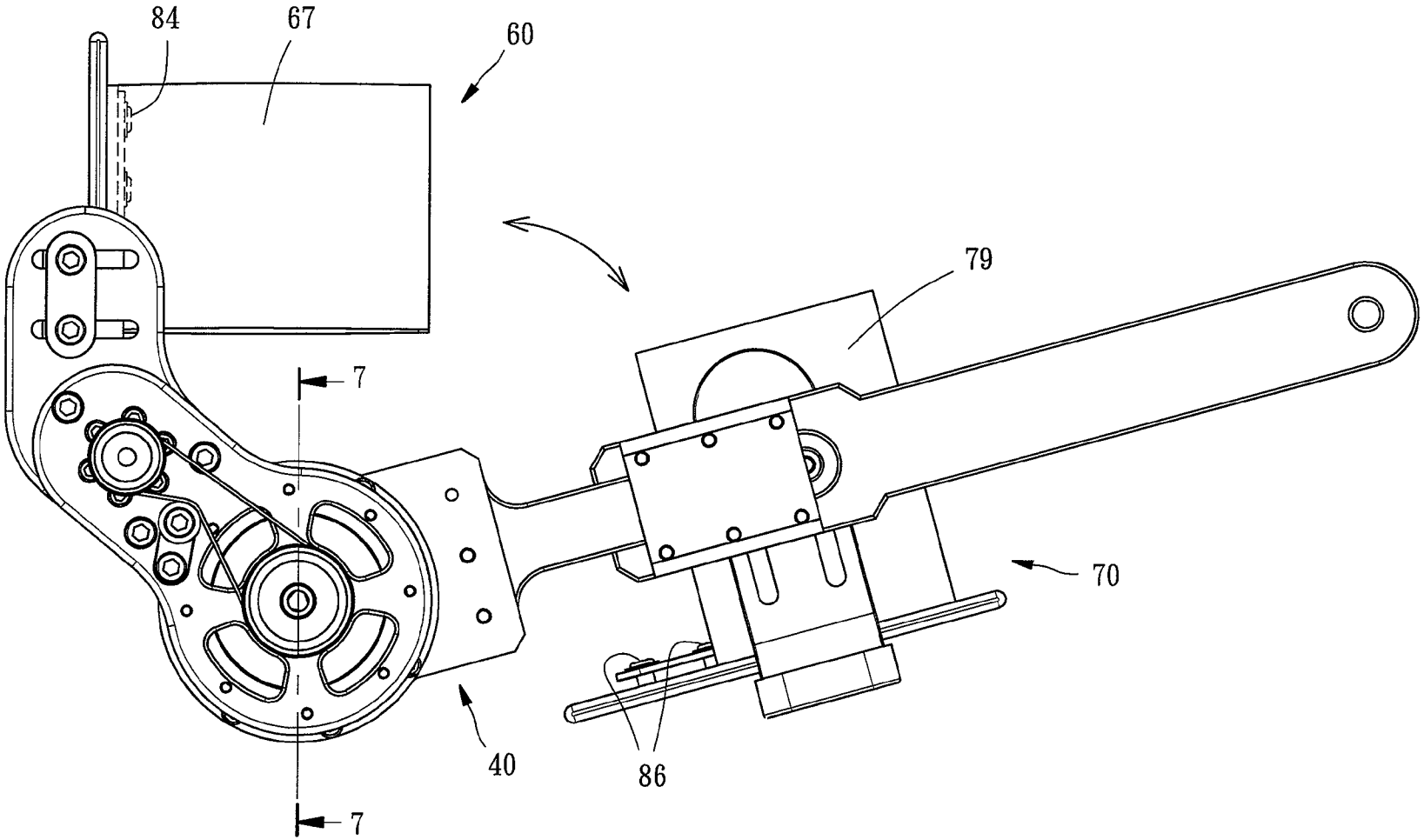
FIG. 6 is a lateral view of the Force feedback type compliant orthotic device of the present invention.
Figure 8:
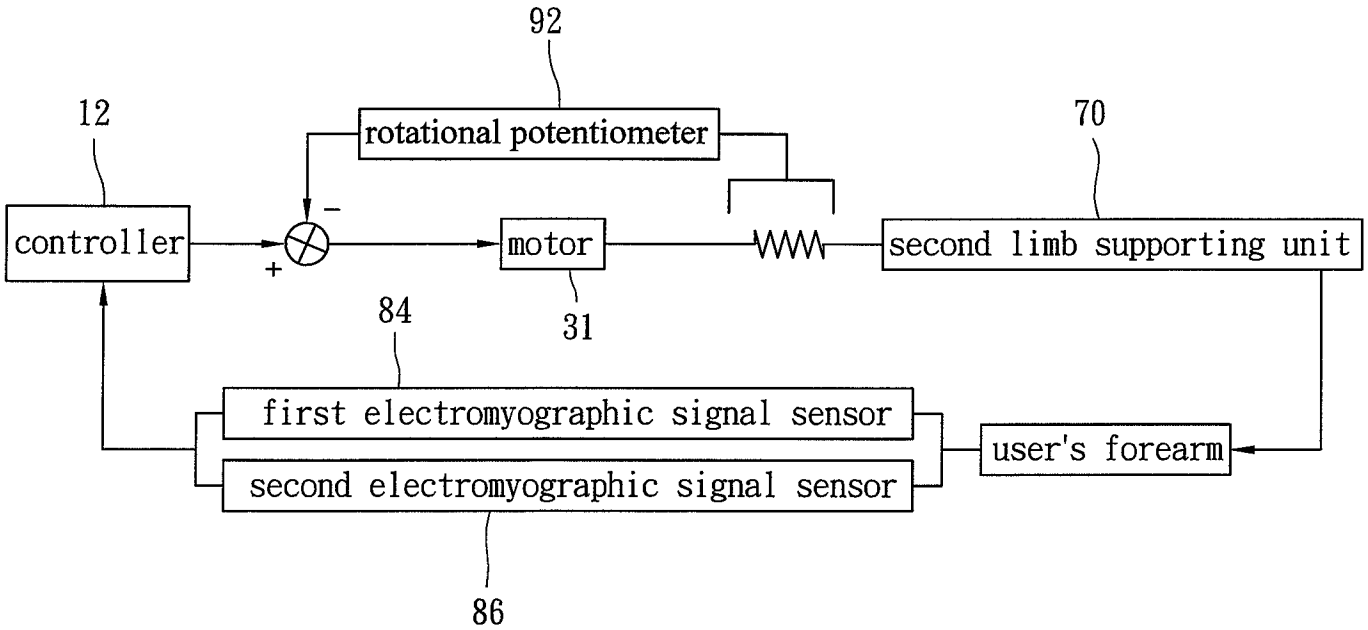
FIG. 8 is a block diagram of the Force feedback type compliant orthotic device of the present invention.

Referring to FIG. 6 through FIG. 8, in the event of a user with a completely malfunctioning forearm, the motor 31 is controlled by a controller 12 and thus driven to rotate clockwise, and at this point in time power is conveyed from the motor 31 to the output shaft 37 through the decelerator 32 and then from the output shaft 37 to the mounting base 51 of the resilience unit 50, such that the joint base 40 is driven by the resilience unit 50 to drive the second limb supporting unit 70 to elevate relative to the first limb supporting unit 60. After the second limb supporting unit 70 has lifted the forearm by a specific distance, the motor 31 is controlled by the controller 12 to rotate anticlockwise such that the second limb supporting unit 70 releases the forearm. The consecutive clockwise and anticlockwise rotation of the motor 31 effectuates rehabilitation of the malfunctioning forearm.

In the event of a user with a partially malfunctioning forearm, the motor 31 is controlled by the controller 12 to operate in an auxiliary force mode or a resistive force mode. In the auxiliary force mode, the user's forearm has to lift the second limb supporting unit 70 to cause the first and second electromyographic signal sensors 84, 86 to start capturing electromyographic signals of the arm and the forearm and send the electromyographic signals thus captured to the controller 12 for judgment. If the controller 12 judges that the user's forearm is too weak to lift the second limb supporting unit 70, the controller 12 will control the motor 31 to rotate clockwise such that power of the motor 31 will assist, through the resilient elements 54 of the resilience unit 50, the user's forearm in lifting the second limb supporting unit 70. When carried out repeatedly, the aforesaid workout achieves the rehabilitation of the forearm.

In the resistive force mode, the controller 12 controls the motor 31 to rotate anticlockwise, such that the motor 31 generates output power to exert a resistive force on the second limb supporting unit 70 through the resilient elements 54 of the resilience unit 50; at this point in time, the user has to oppose the resistive force in order to lift the forearm and thus effectuate rehabilitation thereof. However, the controller 12 adjusts the output power of the motor 31 in real time according to the electromyographic signals captured by the first and second electromyographic signal sensors 84, 86, thereby providing a resistive force of an appropriate strength.

To enable the power generated by the motor 31 to be transmitted to the joint base 40 precisely, the present invention further provides a rotational encoder 90 and a rotational potentiometer 92. As shown in FIG. 2 and FIG. 7, the rotational encoder 90 is mounted on the motor 31 and adapted to measure the angle by which the drive shaft 312 of the motor 31 rotates. The rotational potentiometer 92 passes through the output shaft 37 and has an end fixedly disposed in the rotating shaft 34 and another end fixedly disposed in the connecting shaft 82 to measure angular variation between the rotating shaft 34 and the connecting shaft 82. Hence, the controller 12 compares the measurement result of the rotational encoder 90 and the measurement result of the rotational potentiometer 92 and then corrects the angle by which the drive shaft 312 of the motor 31 rotates in accordance with the difference between the two aforesaid measurement results so as to enhance the precision of operation of the mechanism in its entirety.

In conclusion, according to the present invention, the Force feedback type compliant orthotic device 10 is characterized in that: the motor 31 generates and transmits auxiliary power to the resilience unit 50, such that the resilient elements 54 each undergo deformation to serve a force controlling purpose; muscular functions are assessed according to the electromyographic signals sensed by the first and second electromyographic signal sensors 84, 86; the rotational damper 80 effectuates a damping effect; hence, rehabilitation effect is enhanced, and operation is stable.

What is claimed is:

1. A force feedback type compliant orthotic device, comprising:

a fixing base;

a driving unit having a motor disposed at the fixing base, a decelerator disposed at the fixing base and connected to the motor, and an output shaft connected to the decelerator;

a joint base having a ring portion and a supporting arm, the ring portion being rotatably connected to the decelerator of the driving unit and holding snugly the output shaft of the driving unit, and the supporting arm extending radially and outward from an outer rim surface of the ring portion;

a resilience unit having a mounting base and a plurality of resilient elements disposed at the mounting base, the mounting base holding snugly the output shaft of the driving unit and connecting with an inner rim surface of the ring portion of the joint base;

a first limb supporting unit having a first supporting element and at least a first electromyographic signal sensor, the first supporting element being disposed at the fixing base, and the at least a first electromyographic signal sensor being disposed at the first supporting element; and a second limb supporting unit having a second supporting element and at least a second electromyographic signal sensor, the second supporting element being disposed at the supporting arm of the joint base, and the at least a second electromyographic signal sensor being disposed at the second supporting element.

2. The force feedback type compliant orthotic device of claim 1, wherein the motor has a drive shaft, the decelerator is disposed at the fixing base through a rotating shaft, the driving unit further has a first transmission wheel, a second transmission wheel, and a transmission belt, the first transmission wheel being connected to the drive shaft of the motor, the second transmission wheel being connected to an end of the transmission belt, and the transmission belt winding around the first and second transmission wheels.

3. The force feedback type compliant orthotic device of claim 2, further comprising a rotational potentiometer passing through the output shaft of the driving unit, wherein an end of the rotational potentiometer is fixedly disposed in the rotating shaft of the decelerator.

4. The force feedback type compliant orthotic device of claim 1, wherein the mounting base of the resilience unit has two first frames and a second frame, the first frames each being fixed to an inner rim surface of the ring portion of the joint base, and the second frame being disposed between the two first frames, having an axial hole for receiving snugly the output shaft, and being of a height larger than that of each of the first frames, wherein one of the resilient elements is connected between a top end of the second frame and a top end of one of the first frames, and another one of the resilient elements is connected between a bottom end of the second frame and a bottom end of one of the first frames.

5. The force feedback type compliant orthotic device of claim 1, wherein the first supporting element has a first brace and a first clamp band, the first brace being disposed at the fixing base, and the first clamp band having an outer rim surface disposed at the first brace and an inner rim surface provided with the first electromyographic signal sensor.

6. The force feedback type compliant orthotic device of claim 5, wherein the fixing base has a X-axis adjustment slot, the first brace has a first transverse plate, a first transverse plate fixing element, a first vertical plate, and a first vertical plate fixing element, the first transverse plate has a first Y-axis adjustment slot, the first transverse plate fixing element is disposed slidably in the X-axis adjustment slot of the fixing base and fixed to an end of the first transverse plate, the first vertical plate is connected to the outer rim surface of the first clamp band and has a plurality of Z-axis positioning holes, the first vertical plate fixing element is disposed slidably in the first Y-axis adjustment slot of the first transverse plate and selectively fixedly disposed in one of the Z-axis positioning holes of the first vertical plate.

7. The force feedback type compliant orthotic device of claim 6, wherein the first vertical plate further has a plurality of first fixing holes alternating with the Z-axis positioning holes, and the first electromyographic signal sensors are disposed on the inner rim surface of the first clamp band and each have an end passing through the first clamp band so as to be fixedly disposed in one of the first fixing holes of the first vertical plate.

8. The force feedback type compliant orthotic device of claim 1, wherein the second supporting element has a second brace and a second clamp band, the second brace being disposed at the supporting arm of the joint base, and the second clamp band having an outer rim surface disposed at the second brace and an inner rim surface provided with the second electromyographic signal sensor.

9. The force feedback type compliant orthotic device of claim 8, wherein the second brace has an extension arm, a handle, an L-shaped vertical plate, a second vertical plate fixing element, a second transverse plate, and a second transverse plate fixing element, the extension arm having an end connected to the terminal end of the supporting arm of the joint base and another end provided with the handle, the L-shaped vertical plate having a second Y-axis adjustment slot and a Z-axis adjustment slot, the second vertical plate fixing element being disposed slidably in the Z-axis adjustment slot of the L-shaped vertical plate and fixed to the extension arm, the second transverse plate being connected to the outer rim surface of the second clamp band and having a plurality of X-axis positioning holes, and the second transverse plate fixing element being disposed slidably in the second Y-axis adjustment slot of the L-shaped vertical plate and selectively fixedly disposed in one of the X-axis positioning holes of the second transverse plate.

10. The force feedback type compliant orthotic device of claim 9, wherein the second transverse plate further has a plurality of second fixing holes alternating with the X-axis positioning holes, a plurality of second electromyographic signal sensors are disposed on the inner rim surface of the second clamp band and each have an end passing through the second clamp band and fixedly disposed in one of the second fixing holes of the second transverse plate.

* * * * *